US006948298B2

(12) United States Patent
Lenzen

(10) Patent No.: US 6,948,298 B2
(45) Date of Patent: Sep. 27, 2005

(54) PNEUMATIC STRAPPING MACHINE

(75) Inventor: Peter Wilhelm Lenzen, Sprockhövel (DE)

(73) Assignee: Titan Umreifungstechnik GmbH & Co. KG, Schwelm (DE)

( * ) Notice: Subject to any disclaimer, the term of this patent is extended or adjusted under 35 U.S.C. 154(b) by 0 days.

(21) Appl. No.: 10/807,538

(22) Filed: Mar. 23, 2004

(65) Prior Publication Data

US 2004/0187949 A1 Sep. 30, 2004

(30) Foreign Application Priority Data

Mar. 26, 2003 (DE) ..... 203 04 966 U
Jul. 3, 2003 (DE) ..... 103 30 033

(51) Int. Cl.[7] ..... B65B 13/22

(52) U.S. Cl. ..... 53/592; 53/375.8; 100/30; 100/32; 140/93.4; 156/579

(58) Field of Search ..... 53/592, 375.8, 53/375.9; 100/29, 30, 32, 33 PB; 140/93.4; 156/579

(56) References Cited

U.S. PATENT DOCUMENTS 3,198,218 A * 8/1965 Ericsson et al. ..... 140/93.4
3,329,178 A * 7/1967 Plunkett ..... 140/93.4
3,334,695 A * 8/1967 Rosenberger et al. ..... 140/93.4
3,442,733 A * 5/1969 Vilcins ..... 53/592
3,506,041 A * 4/1970 Angarola ..... 140/93.4
3,524,480 A * 8/1970 Dunn ..... 140/93.4
4,243,077 A * 1/1981 Sansum ..... 140/93.4
4,245,678 A * 1/1981 Sansum ..... 140/93.4
4,957,587 A * 9/1990 Rauch ..... 53/592
5,694,749 A * 12/1997 Oseland ..... 53/592
5,738,152 A 4/1998 Crittenden ..... 140/93.4
6,360,804 B1 * 3/2002 Field et al. ..... 156/579
2004/0206251 A1 * 10/2004 Nix ..... 100/29

FOREIGN PATENT DOCUMENTS

DE 20206275 U1 * 9/2002 ..... B65B/13/00

* cited by examiner

*Primary Examiner*—Stephen F. Gerrity
(74) *Attorney, Agent, or Firm*—Herbert Dubno Andrew Wilford

(57) ABSTRACT

A strapping machine has a housing carrying a mount attachable to an overhead balancer line, tensioning and sealing devices in the housing, and an elongated pivotal handle. An inner handle end is formed with an annular inlet passage and a radially throughgoing inlet port opening into the inlet passage. The handle also is formed with axially extending passages extending from the inlet passage to an outer handle end. A pneumatic motor in the outer handle end drives a transmission in the inner end of the handle in turn drives the devices in the housing. An inlet fitting on the housing is connectable to a compressed-air supply line. A conduit has one end communicating with the inlet fitting and an opposite end opening radially inward into the inlet port of the handle. The outer handle end is formed with an outlet opening for venting air from the motor.

9 Claims, 4 Drawing Sheets

PNEUMATIC STRAPPING MACHINE

FIELD OF THE INVENTION

The present invention relates to strapping machine. More particularly this invention concerns pneumatic strapping machine of the type that is typically suspended from a tool balancer.

BACKGROUND OF THE INVENTION

A standard pneumatic combination-type strapping machine typically comprises a tensioner for pulling a strap tight about an object and a sealer/cutter for crimping a seal on the overlapping portions of the strap or for crimping the overlapping portions together and cutting them from the strap supply. It is standard for such a device to be pneumatically powered, as the force necessary for tensioning and sealing is considerable, so that the equipment houses an air-powered motor.

In order to be able to close the device around the free end of the strap wrapped around the object and the overlying portion of strap extending from the supply coil, it is standard to make the strapping machine of two relatively pivotal parts, a housing and a handle. The handle normally holds the pneumatic motor and can pivot between an open and closed position on the housing. Since the motor must be supplied with gas under pressure, the standard system typically has a quick-connect plug at the outer end of the handle. Air thus flows inward from this plug through the motor when a valve in the device is actuated, and then flows back out to the handle outer end whence it is exhausted to the atmosphere. The outer end of the handle holds the motor, which basically comprises a rotor impeller that is set in rotation as pressurized gas moves axially inward through it, and the inner end of the handle holds a transmission that converts the high-speed low-torque rotation of the motor into low-speed high-torque rotation of a shaft that operates the sealer and/or tensioner situated near the inner handle end.

When such a tool, which can be fairly heavy, is suspended from a standard tool balancer, typically constituted as a cable suspended from an overhead windup device that is set to apply an upward force on the cable equal to the tool weight, the device can be moved about below the windup device with relative ease. To this end the heavy housing is provided with a mount or eye to which the lower end of the balancer cable is connected. The air hose for the tool also normally is attached to this cable, but diverges from the cable near its lower end so that it can be connected to the outer end of the handle. Such an installation is clumsy in the extreme as the user must wrestle with the air hose and balancer cable, making it difficult to handle and position the tool.

OBJECTS OF THE INVENTION

It is therefore an object of the present invention to provide an improved pneumatic strapping machine.

Another object is the provision of such an improved pneumatic strapping machine which overcomes the above-given disadvantages, that is which is convenient to use even when suspended from an overhead balancer cable or chain.

SUMMARY OF THE INVENTION

A strapping machine has according to the invention a housing, a mount on the housing attachable to an overhead balancer line, tensioning and sealing devices in the housing, and an elongated handle pivotal about an axis on the housing between an open position and a closed position and having an outer end remote from the axis and an inner end close to the axis. The inner end of the handle is formed with an annular inlet passage and a radially throughgoing inlet port opening into the inlet passage. The handle also is formed with axially extending passages extending from the inlet passage to the outer handle end. A pneumatic motor in the outer handle end is connected to a transmission in the inner end of the handle in turn connected to the tensioning and sealing devices in the housing. An inlet fitting on the housing is connectable to a compressed-air supply line. A conduit has one end connected to the housing and communicating with the inlet fitting and an opposite end opening radially inward into the inlet port of the handle so that compressed air from the inlet fitting can flow through the conduit and the inlet port to the inlet passage and thence via the axial passages to the motor to power same. The outer handle end is formed with an outlet opening for venting air from the motor.

Thus according to the instant invention the air-supply hose or line does not extend from the outer end of the handle, but instead extends from the fitting on the housing. According to the invention this fitting can be juxtaposed with the balancer-line mount and can even be aligned with its center, so that the combined balancer line and air hose follow similar paths and offer no hindrance to using the machine. Indeed the machine is as easy to use as if it had no air-supply line at all.

According to the invention the axial passages are formed by axially extending and radially inwardly open grooves in the handle and by an outer surface of the transmission radially inwardly closing the grooves. The handle is formed at the outer handle end with an annular outlet passage into which the axially extending grooves open and that in turns opens into the motor. A seal compressed radially between the rotor and an inner surface of the handle is positioned between the outlet passage and the inner handle end. This is an extremely compact construction that nonetheless serves to conduct the air from the inner handle end past the transmission to the inner inlet end of the motor, whence the air escapes through the vent ports on the handle outer end. To this end the handle has at its outer end an end cap formed with the outlet opening or openings, and is provided internally with sound-deadening material forming a muffler in the cap between the cap and the rotor.

The conduit in accordance with the invention is fixed on the handle and the one end of the conduit is rotatably connected at the axis to the housing. The machine further has according to the invention a valve block in the housing connected between the inlet fitting and the one end of the conduit. This conduit has one end extending parallel to and offset from the axis and fixed to the handle and another end on the axis and rotatably seated at the axis in the valve block. The one arm is provided with a flow-adjusting valve, typically formed as a standard flow-restricting screw that is screwed in to reduce the flow cross section of the conduit and screwed out to increase it.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
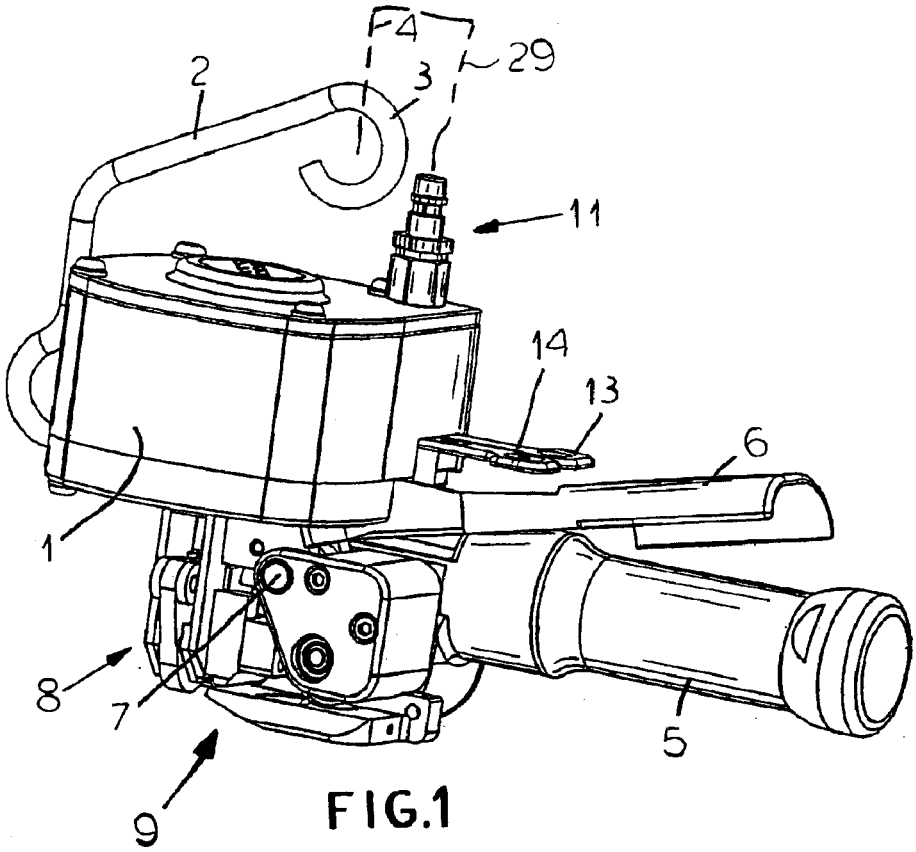
FIGS. 1 and 2 are perspective views of the strapping machine according to the invention with the handle in the open position.
Figure 2:
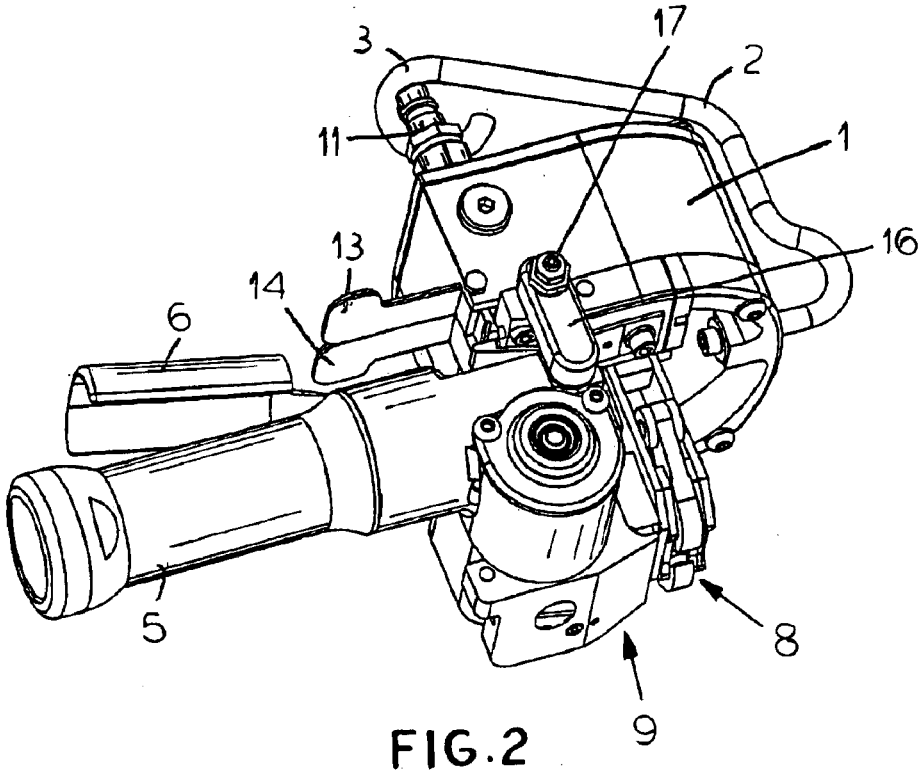
Figure 3:
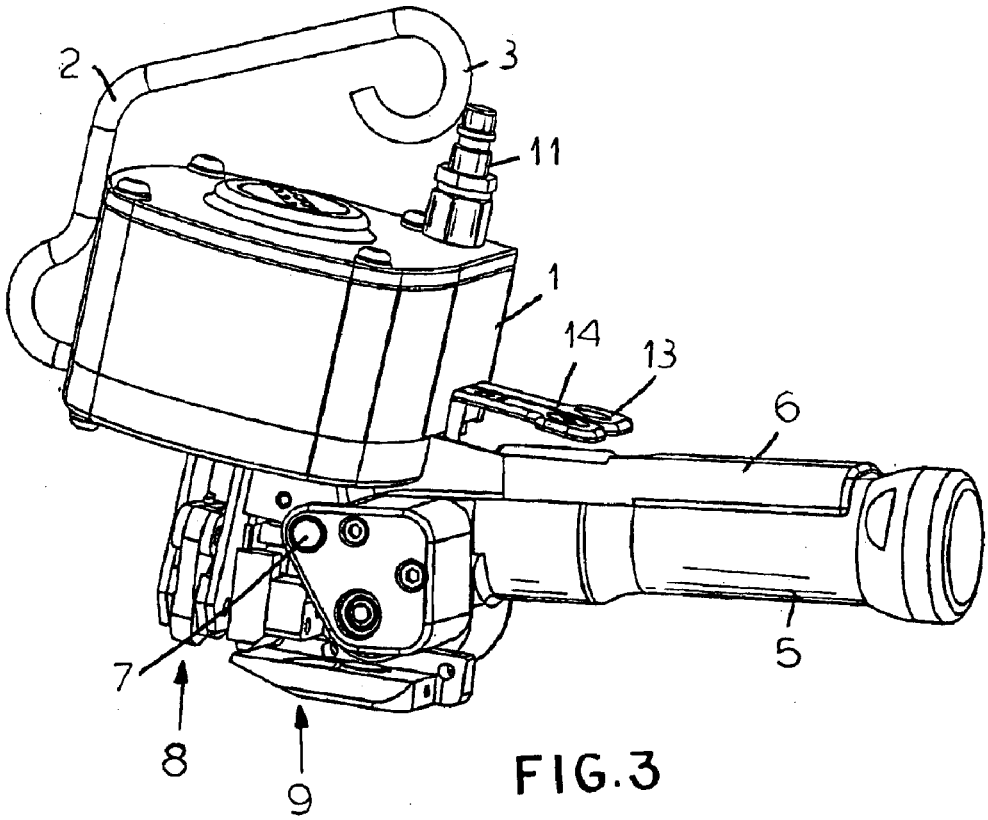
FIGS. 3 and 4 are perspective views of the trapping machine with the handle in the closed position.
Figure 4:
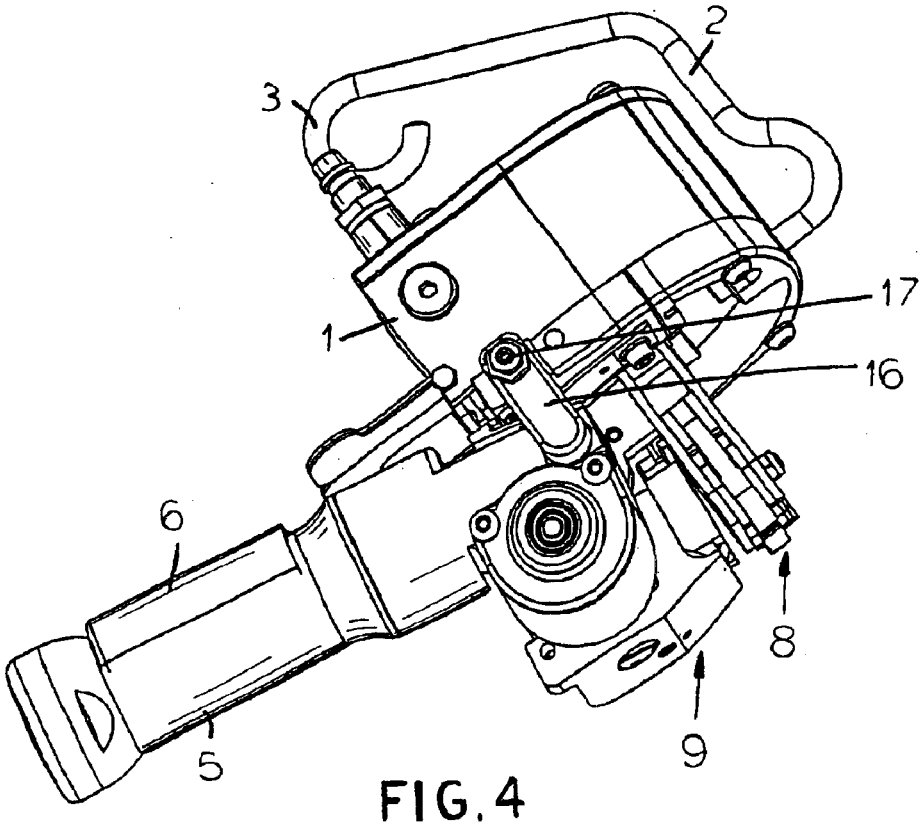
Figure 5:
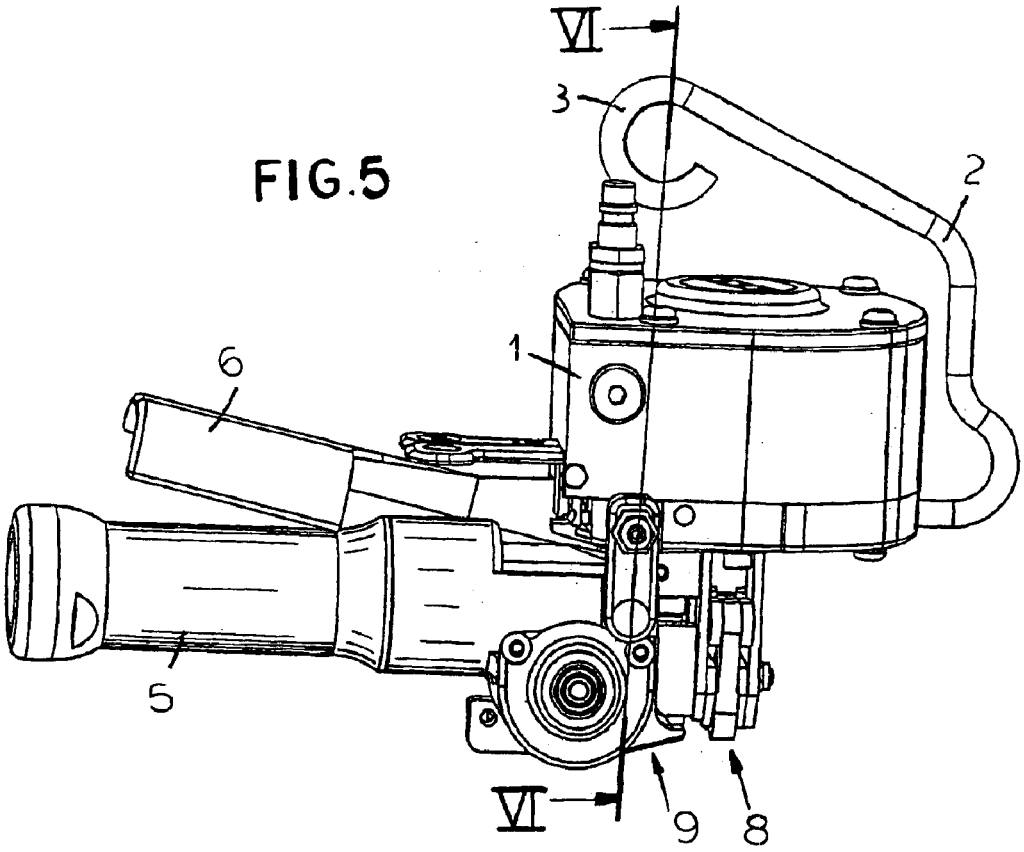
FIG. 5 is a side view of the machine with the handle in the open position.

As seen in FIGS. 1 through 5, a strapping machine according to the invention basically has a fairly heavy cast-metal housing 1 provided with a mount 2 having an end eye or hook 3 for a balancer line or cable shown schematically by a dashed line at 4 so that the housing 1 can be suspended at a work station. A handle 5 is pivotal about an axis 7 on the housing 1 relative to a fixed handle part 6 and can move between the open position of FIGS. 1 and 2 with the handle 5 spaced from the part 6 so that straps S (FIG. 6 only) can be threaded through the machine and the closed position of FIGS. 3 and 4 in which the straps S are clenched in the housing 1. The housing 1 incorporates a sealer 8 and a tensioner 9 of standard construction. The tensioner 9 is partly built into the handle 5.

Both the sealer 8 and the tensioner 9 are powered by a drive 10 mainly incorporated in the pivotal handle 5. According to the invention the housing 1 carries near the balancer eye 3 an inlet fitting constituted as a standard quick-connect plug 11 for a pneumatic hose indicated by a dashed line schematically at 29 and normally attached to the balancer line 4. This inlet plug 11 is connected with a valve assembly 12 in the housing 1 that is operated by buttons 13 and 14 on the housing 1 for operating the sealer 8 and tensioner 9.

Figure 6:
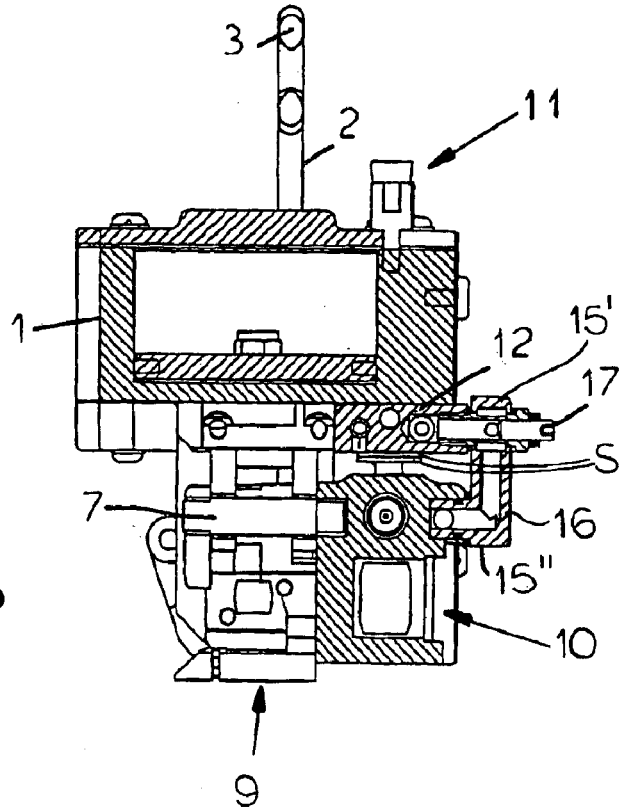
FIG. 6 is a section taken along line VI—VI of FIG. 5.

Further in accordance with the invention and as shown in FIG. 6 the valve assembly 12 is connected to the drive 10 by a rigid conduit or fitting 16 having one leg 15' attached fixedly to the valve assembly 12 on the housing 1 offset from the axis 7 and another leg 15" fixed rotatably on the inner end of the handle 5 at the axis 7 so the handle 5 can pivot freely without moving the conduit 16. The inner leg 15' on the housing 1 is provided with a flow-adjustment screw 17 that can be screwed in and out to change the flow cross-section of the conduit 16.

Figure 8:
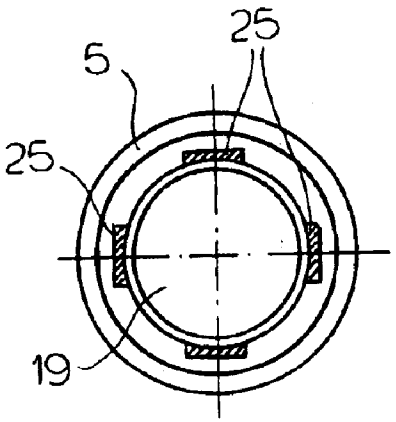
FIG. 8 is a cross section taken along line VIII—VIII of FIG. 7.
Figure 7:
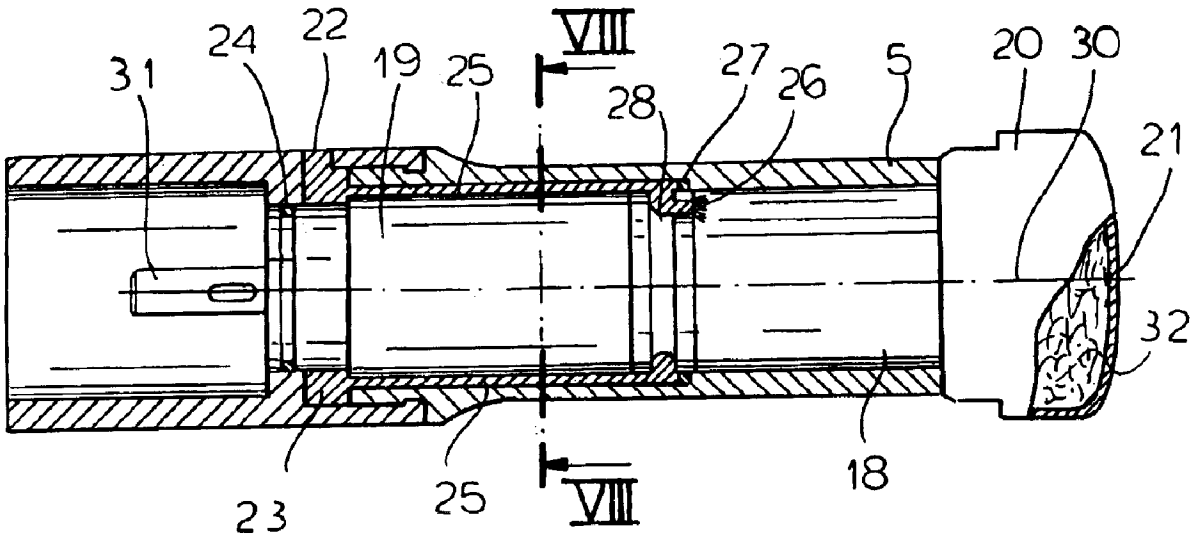
FIG. 7 is an axial section through the handle.

The drive 10 in the basically cylindrical handle 5 comprises as shown in FIGS. 7 and 8 a rotor 18 of standard type at the outer end of the handle 5 and intended to be rotated about an axis 30 of the handle by jets of compressed air as shown at 26 and a transmission 19 toward the inner handle end and having an output shaft 31 connected to the sealer 8 and tensioner 9. The handle 5 has at its inner end an input 22 for compressed air and at its outer end at an end cap 20 an outlet 21 for spent air. From the inlet 22 the air flows into an annular passage 23, then through four angularly equispaced and axially extending grooves 25 into a forwardly open groove 28 that forms the air jets 26 that pass through the rotor 18, spinning it about the axis 30 and driving the shaft 31 via the transmission 19. A seal ring 24 around the inner end of the transmission 19 seals it in the tubular outer body of the handle 5 and another seal ring 27 at the outer end seals around the rotor 18 just upstream of the groove 28. The cap 29 can hold wire mesh 32 or the like as a muffler.

I claim:

1. A strapping machine comprising:

a housing;

a mount on the housing attachable to an overhead balancer lines;

tensioning and sealing devices in the housing;

an elongated handle pivotal about an axis on the housing between an open position and a closed position and having an outer end remote from the axis and an inner end close to the axis, the inner end of the handle being formed with an annular inlet passage and a radially throughgoing inlet port opening into the inlet passage, the handle also being formed with axially extending passages extending from the inlet passage to the outer handle end;

a pneumatic motor in the outer handle end;

a transmission in the inner end of the handle and connected to the motor and to the tensioning and sealing devices in the housing;

an inlet fitting on the housing connectable to a compressed-air supply line; and a conduit having one end connected to the housing and communicating with the inlet fitting and an opposite end opening radially inward into the inlet port of the handle, whereby compressed air from the inlet fitting can flow through the conduit and the inlet port to the inlet passage and thence via the axial passages to the motor to power same, the outer handle end being formed with an outlet opening for venting air from the motor.

2. The strapping machine defined in claim 1 wherein the axial passages are formed by axially extending and radially inwardly open grooves in the handle and by an outer surface of the transmission radially inwardly closing the grooves.

3. The strapping machine defined in claim 2 wherein the handle is formed at the outer handle end with an annular outlet passage into which the axially extending grooves open and that in turn opens into the motor.

4. The strapping machine defined in claim 3, further comprising a seal compressed radially between the transmission and an inner surface of the handle and positioned between the outlet passage and the inner handle end.

5. The strapping machine defined in claim 1 wherein the handle outer end carries an end cap formed with the outlet opening.

6. The strapping machine defined in claim 5, further comprising sound-deadening material forming a muffler in the cap between the cap and the transmission.

7. The strapping machine defined in claim 1 wherein the inlet fitting is closely juxtaposed and aligned with a center of the mount, the conduit being fixed on the handle and the one end of the conduit being rotatably connected at the axis to the housing, the machine further comprising:

a valve block in the housing connected between the inlet fitting and the one end of the conduit.

8. The strapping machine defined in claim 7 wherein the conduit has one end extending parallel to and offset from the axis and fixed to the handle and another end extending on the axis and rotatably seated at the axis in the valve block.

9. The strapping machine defined in claim 8 wherein one of the conduit ends is provided with a flow-adjusting valve.

* * * * *